US011930890B2

(12) United States Patent
Wehrmeyer

(10) Patent No.: US 11,930,890 B2
(45) Date of Patent: Mar. 19, 2024

(54) LACE-RECEIVING STRUCTURE FOR ARTICLES OF FOOTWEAR

(71) Applicant: NIKE, Inc., Beaverton, OR (US)

(72) Inventor: Brenton Wehrmeyer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/219,605

(22) Filed: Mar. 31, 2021

(65) Prior Publication Data

US 2022/0312897 A1 Oct. 6, 2022

(51) Int. Cl.
*A43C 1/04* (2006.01)
*A43C 5/00* (2006.01)
*A43C 7/02* (2006.01)

(52) U.S. Cl.
CPC ..... *A43C 1/04* (2013.01); *A43C 5/00* (2013.01); *A43C 7/02* (2013.01)

(58) Field of Classification Search
CPC ..... A43C 7/02; A43C 1/04; A43C 5/00
See application file for complete search history.

(56) References Cited

U.S. PATENT DOCUMENTS 712,003 A * 10/1902 Payne ..... A43C 1/04 24/714.7
1,170,296 A * 2/1916 Saunders ..... A43C 5/00 24/715.1
4,296,558 A * 10/1981 Antonious ..... A43C 11/1493 36/102
4,394,803 A * 7/1983 Goldstein ..... A43C 11/008 36/71
11,129,445 B1 * 9/2021 Murphy-Reinhertz ... A41F 1/00
2005/0015948 A1 * 1/2005 Issler ..... A43C 3/00 24/714.8
2007/0227045 A1 * 10/2007 Aveni ..... A43B 3/24 36/8.3
2009/0277043 A1 11/2009 Graser et al.
2012/0174437 A1 * 7/2012 Heard ..... A43C 1/04 36/50.1
2013/0019501 A1 * 1/2013 Gerber ..... A43C 1/04 36/50.1
2013/0111782 A1 * 5/2013 Tsai ..... A43C 1/04 36/50.1
2016/0366980 A1 * 12/2016 Bell ..... A43C 1/04
2017/0065027 A1 3/2017 Hyde et al.
2017/0065028 A1 * 3/2017 Foster ..... A43C 7/00
(Continued)

OTHER PUBLICATIONS

International Search Report and Written Opinion, dated May 31, 2022, issued for International Application No. PCT/US2022/020223, 11 pages.

*Primary Examiner* — Katharine G Kane
(74) *Attorney, Agent, or Firm* — Klarquist Sparkman, LLP

(57) ABSTRACT

This disclosure is directed to lace-receiving structures that may be included in articles of footwear. The lace-receiving structure can include a first longitudinal portion, a second longitudinal portion spaced apart from the first longitudinal portion to define a gap therebetween, and an intermediate portion that includes a first folded region adjacent the first longitudinal portion and a second folded region adjacent the second longitudinal portion. The lace guide can be a continuous piece of material that includes the first portion, the intermediate portion, and the second portion.

16 Claims, 9 Drawing Sheets

(56) References Cited

U.S. PATENT DOCUMENTS

| | | | | |
|---|---|---|---|---|
| 2017/0079372 | A1* | 3/2017 | Duarte | A43B 7/226 |
| 2020/0008523 | A1* | 1/2020 | Luedecke | A43B 9/02 |
| 2020/0170349 | A1* | 6/2020 | Verfl | A43B 23/0275 |
| 2021/0059357 | A1* | 3/2021 | Santos | D04C 1/06 |

* cited by examiner

LACE-RECEIVING STRUCTURE FOR ARTICLES OF FOOTWEAR

FIELD

This disclosure relates generally to articles of footwear and more particularly to lace-receiving structures for articles of footwear.

BACKGROUND

An article of footwear (also referred to herein as "the article" or "the footwear") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

The article of footwear can also include a closure system that includes one or more lace members (e.g., cords, strips, or other elongate members) that can be released and/or loosened to allow the wearer to insert their foot into or remove their foot from the article of footwear, and tightened and/or fastened to secure the wearer's foot within the article of footwear. Improvements in the manufacturing and/or functioning of closure systems are always desirable.

BRIEF DESCRIPTION

Aspects and advantages of the disclosed technology will be set forth in part in the following description, or may be obvious from the description, or may be learned through practice of the technology disclosed in the description.

Disclosed herein are lace-receiving members for articles of footwear. For example, a lace guide can include a first longitudinal portion, a second longitudinal portion spaced apart from the first longitudinal portion to define a gap therebetween, and an intermediate portion that includes a first folded region adjacent the first longitudinal portion and a second folded region adjacent the second longitudinal portion. The lace guide can be a continuous piece of material that includes the first portion, the intermediate portion, and the second portion.

In some embodiments, the lace guide can be attached to an article of footwear. The article of footwear can include an upper that has a lateral side, a medial side, and a throat area between the medial and lateral sides and the lace guide attached to the upper. The lace guide can comprise a first portion that extends along the medial side of the upper, a second portion that extends along a lateral side of the upper, and an intermediate portion that extends between the first and second portions. When attached to the upper, the first portion and second portion of the lace guide can at least partly define a plurality of apertures for receiving a lace member. The lace guide can be a continuous piece of material that includes the first portion, the intermediate portion, and the second portion.

Methods of constructing the lace guide and articles of footwear that include lace guides are also disclosed herein.

These and other features, aspects, and/or advantages of the present disclosure will become better understood with reference to the following description and the claims. The accompanying drawings, which are incorporated in and constitute a part of this specification, illustrate embodiments of the disclosed technology and, together with the description, explain the principles of the disclosure.

DETAILED DESCRIPTION

General Considerations

Figure 1:
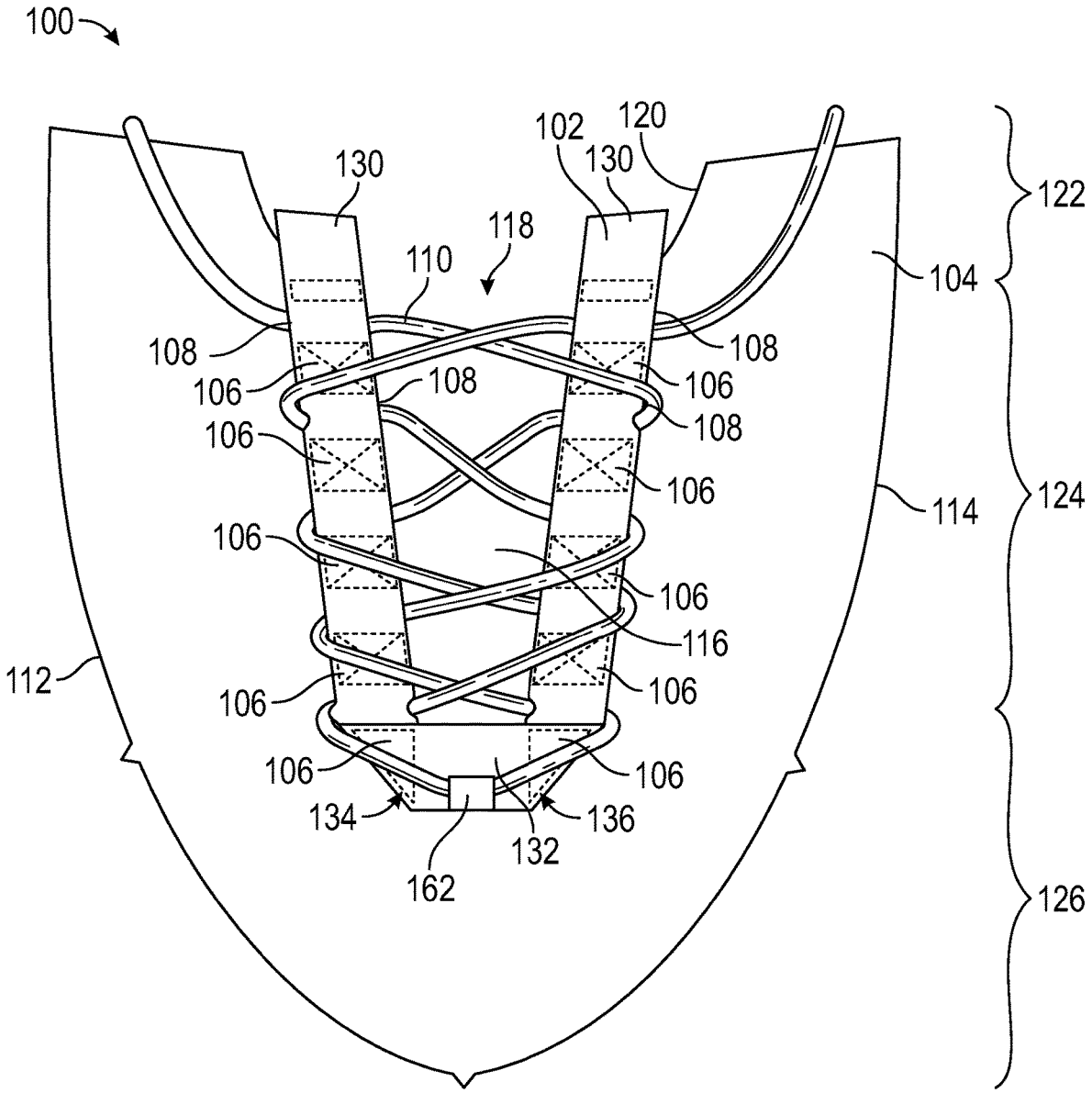
FIG. 1 is a perspective view of an exemplary embodiment of a lace-receiving structure shown attached to a flat-formed upper.

The apparatuses and devices described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the term "upper" refers to any combination of materials that is coupled to the sole structure and is configured to restrict relative movement between a wearer's foot and the sole structure (i.e., to secure the wearer's foot to the sole structure). For example, the upper may be configured to extend over and/or above at least a portion of a wearer's foot (e.g., toes, forefoot, midfoot, etc.) and may form a foot-receiving cavity. The upper may additionally or alternatively be configured to protect the wearer's foot.

As used herein, the terms "throat" and "throat area" generally refer to an opening, gap, or other spaced-apart area between the medial and lateral sides of an upper that can be spanned by one or more lace members.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process.

As used herein, the terms "lace-receiving structure" or "lace guide" means any type of structure that is configured to receive and retain one or more lace members, either alone or in combination with the upper when constructed. As used herein, the term "lace member(s)" means any elongate members that can adjust and/or secure the article of footwear relative to a wearer's foot, such as a shoelace, string, cable, cord, wire, band, strap, or other elongate tensioning structure. As an example, the lace-receiving structure may define one or more apertures (such as a channel) through which the lace member(s) can extend. When included in an article of footwear, the lace-receiving structure is configured to adjustably couple the lace member(s) to the article of footwear.

As used herein, the term "strip" or "strip of material" generally refers to an elongate continuous material capable of extending along both sides of the throat area to provide the apertures as described herein.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

The Disclosed Technology and Exemplary Embodiments

FIG. 1 illustrates a portion of an article of footwear 100 that has a lace-receiving structure or lace guide 102 attached to an upper 104. The lace guide 102 is a continuous elongate length of material that is secured to the upper 104 at a plurality of attachment regions 106 along its length. The lace guide 102 defines a plurality of apertures 108 between at least some adjacent attachment regions 106 through which one or more lace members 110 can be received.

As shown in FIG. 1, the lace guide 102 can comprise a single, continuous length of material that extends along a first side 112 (e.g., a medial side) and a second side 114 (e.g., a lateral side) to define a lace-receiving area 116 across a throat area 118 of the upper 104, which is located forward of a collar 120. The throat area 118 generally corresponds to a portion of the article of footwear that can be expanded to receive a foot of the wearer and contracted to secure the article of footwear to the foot when the lace member(s) are tightened.

Figure 2:
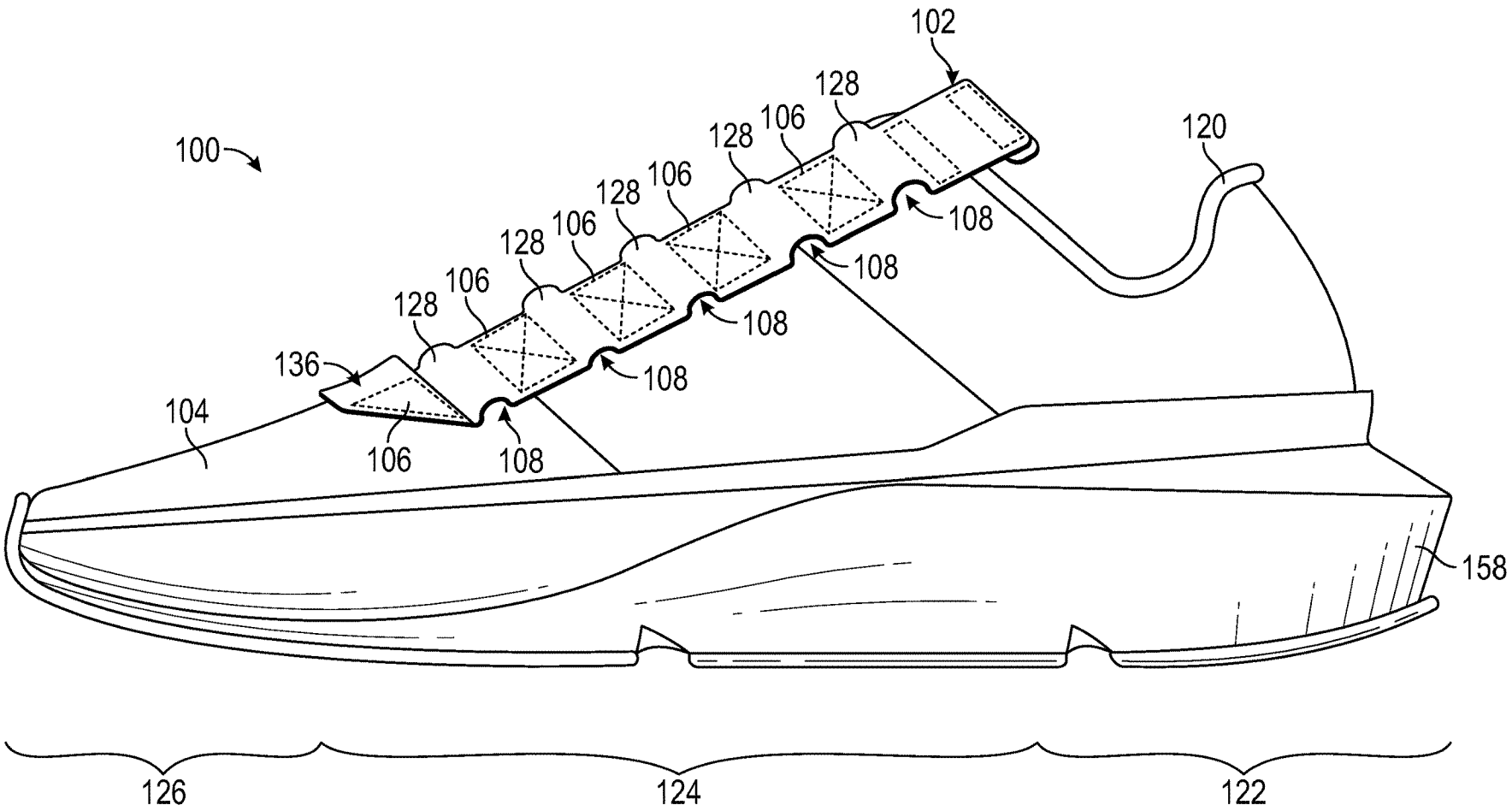
FIG. 2 is a side view of an exemplary embodiment of a lace-receiving structure attached to an upper of an article of footwear.

As shown in FIG. 2, the article of footwear can comprise a heel region 122, a midfoot region 124, and a toe region 126. Although the extent of the throat area 118 can vary, in some embodiments the throat area 118 is primarily located in the midfoot region. As shown in FIG. 2 and other figures herein, the lace member 110 can pass through the apertures 108 and follow a zigzagging path across throat area 118 and between apertures 108 on opposite sides of throat area 118. It should be understood that any lacing pattern can be used, and the location of apertures and the manner in which the lace member passes through the apertures can vary. For example, although the lateral and medial side apertures are generally aligned relative to each other in the figures, it should be understood that a different lacing pattern could accommodate positioning the apertures in different locations.

When wearing the article of footwear 100, lace member 110 permits the wearer to modify the various dimensions of the upper 104, including the width of the throat area 118, to accommodate the proportions of the foot. More particularly, lace member 110 may be manipulated in a conventional manner to permit the wearer to (a) tighten upper 104 around the foot and (b) loosen upper 104 to facilitate insertion and withdrawal of the foot from the void in upper 104 (i.e., through the opening formed by collar 120).

Referring again to FIG. 2, it will be understood that the apertures 108 define passageways or channels that extend from a first side of a respective aperture 108 to a second side of that aperture 108. As described below, a width of the passageways or channels defined by the apertures can vary. The passageways or channels of the apertures 108 are collectively defined by unattached regions 128 of the lace guide 102 that partially surround the passageways, and the portion of the upper 104 that extends below the unattached regions 128. As shown in FIG. 2, adjacent unattached regions 128 are spaced-apart from one another along each side of the throat area 118 by attached regions 106.

Referring again to FIG. 1, the lace guide 102 comprises a first side 130 and a second, opposite side 132. The lace guide 102 can be folded to form a first folded portion 134 and a second folded portion 136 towards the forward end of the throat area 118. Thus, the first side 130 forms a top surface of the lace guide 102 along both the medial and lateral sides of the throat area 118, while the second side 132 forms a top surface of the lace guide 102 adjacent the forward end of the throat area 118. The folding of the lace guide 102 in this manner allows for the formation of two opposing lace-receiving areas (e.g., one on the medial side and one on the lateral side) from a single continuous strip of material. As shown in FIGS. 1 and 2, in some embodiments, the lace guide 102 can be secured to the upper at various locations, including at the folded portions 134, 136.

It should be appreciated that the lace-receiving structures illustrated and described herein may comprise different geometries (sizes, shapes, thickness, widths, lengths, relative sizing and/or positioning of components, etc.). For example, the lace guide 102 shown in FIG. 1 may be wider or thinner along its length, defining different width passageways of the apertures. In addition, a thickness of the material of the lace guide can vary.

The attached regions 106 and folded portions 134, 136 can secured to the upper 104 by stitching, such as by a plurality of box stitches for the attached regions and a triangular stitch for the folded regions as shown in FIGS. 1 and 2. However, it should be understood that the attachment of the lace guide 102 to the upper can be achieved by any suitable means for securing the lace guide to the upper so that the resulting structure can function as a lace guide as described herein, including any suitable type of stitching, adhesives, ultrasonic welding, rivets or other mechanical fasteners, or any combination of these or other suitable fastening technology.

The lace guide can be formed of any suitable material that is a continuous structure capable of extending along both sides of the throat area to provide apertures as described herein, as well as being capable of being folded to facilitate the transition between the two sides. For example, the lace-receiving structure can be constructed from, formed of, and/or comprise one or more of textiles, leather, synthetic leather, foam, and/or polymers (e.g., rubber and/or plastic).

In the figures shown herein, the lace guides 102 are depicted as generally solid strips of material so that when viewed from above, the lace members 110 are not visible through the unattached regions 128. However, it should be understood that the lace guides can be constructed so that a least a portion of the lace members 110 would be visible through the unattached regions 128. For example, the lace guides 102 can comprise mesh or other materials that have one or more openings, windows, and/or transparent/partially-transparent areas that provide visibility through at least a portion of the lace guides 102.

Figure 3A:
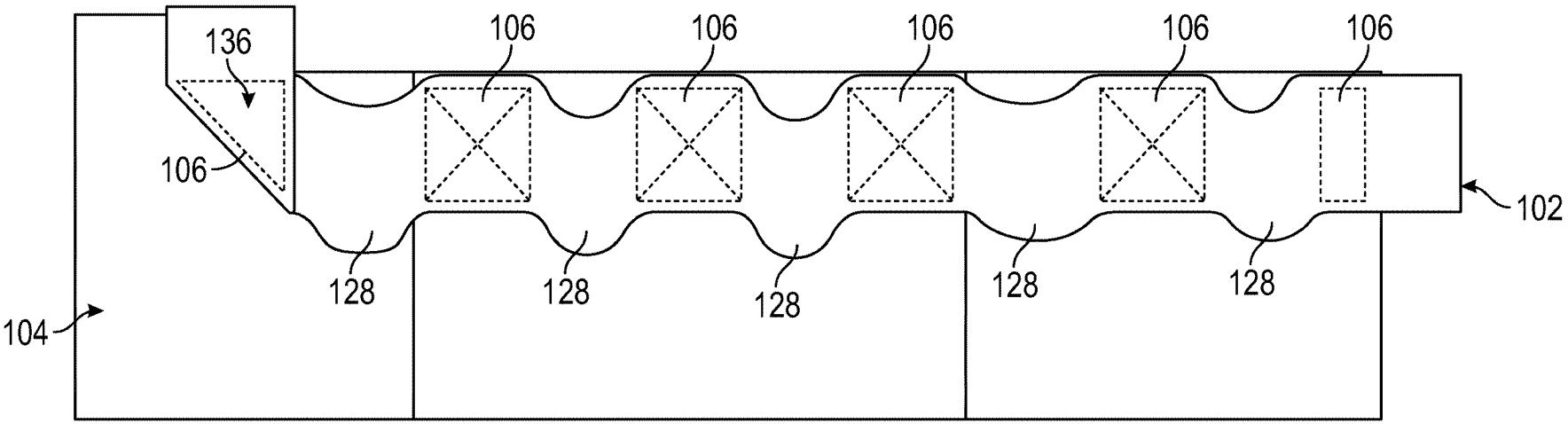
FIGS. 3A and 3B illustrate views of an exemplary lace-receiving structure attached to a surface of an upper.
Figure 3B:
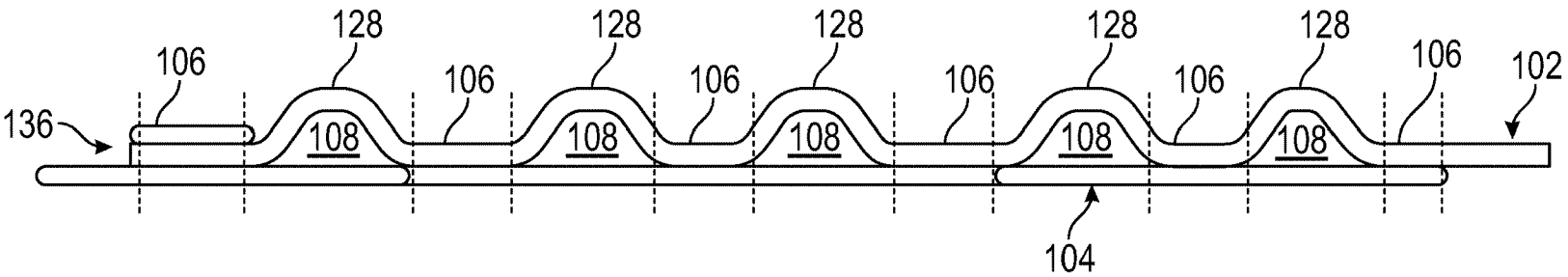

FIGS. 3A and 3B illustrate additional details of an exemplary lace guide 102 attached to an upper 104. As shown in FIGS. 3A and 3B, the attached regions 106, which can include the folded portions in some embodiments, and adjacent unattached regions 128 define, in combination with the underlying surface of the upper 104, a plurality of apertures through which one or more lace members can be received.

Figure 4:
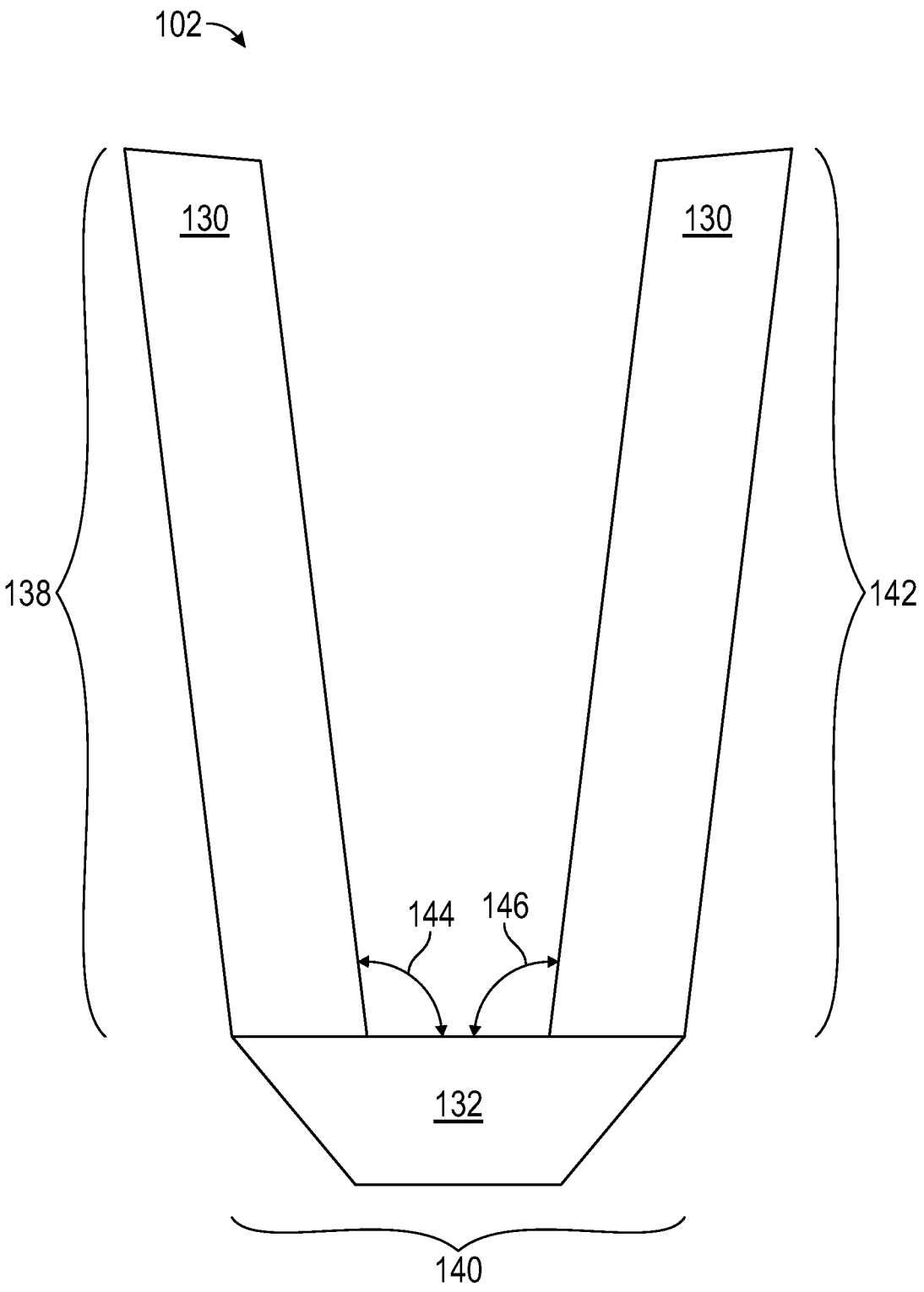
FIG. 4 is a top view of an exemplary lace-receiving structure shown in a folded configuration.

FIG. 4 illustrates an exemplary lace guide 102 prior to attachment to an upper. As shown in FIG. 4, a first portion 138 of the lace guide 102 extends to form a lace-receiving structure on a medial/lateral side of a throat area and a second portion 142 on the other one of the medial/lateral side of the throat area. An intermediate portion 140 extends between the first and second portions 138, 142. The first and second portions 138, 142 of lace guide 102 have a first side 130 of the lace guide 102 exposed (i.e., facing up), while the lace guide 102 folds over at both ends of the intermediate portion so that the second, opposite side 132 of the lace guide 102 is exposed.

As shown in FIG. 4, the first and second portions 138, 142, can be folded to define a first angle 144 and a second angle 146. In some embodiments, the first and second angles are the same. In some embodiments, the first and second angles can be greater than 90°, such as between 90° and 110°, between 95° and 110°, or, in other embodiments, between 95° and 105°.

The lace guide 102 in FIG. 4 is illustrated with the intermediate portion 140 extending on top (i.e., the intermediate portion has the second side 132 exposed); however, it should be understood that the lace guides 102 disclosed herein can be reversed (e.g., flipped over). As will be easily understood in view of this disclosure, in a reversed configuration the top exposed area of the first and second portions 138, 142 would be the second side 132 and the intermediate portion 140 would have a central area with the first side 130 exposed and the folded regions would have a top surface formed from the second side 132.

The manner in which the lace guide 102 can be formed into the first portion 138, intermediate portion 140, and second portion 142 can vary. For example, in one embodiment, the lace guide 102 can simply be folded over to and secured to the upper without any preforming or additional treatment of the lace guide 102.

In other embodiments, however, the lace guide 102 can be additionally treated to maintain a desired shape prior to attachment to the upper. For example, the lace guide 102 can be folded as shown in FIG. 4 and the facing surfaces of the folded portions can be secured to one another such as by stitching, heat treatment, adhesive, mechanical fasteners, or any combination of these or other securing steps.

Figure 5:
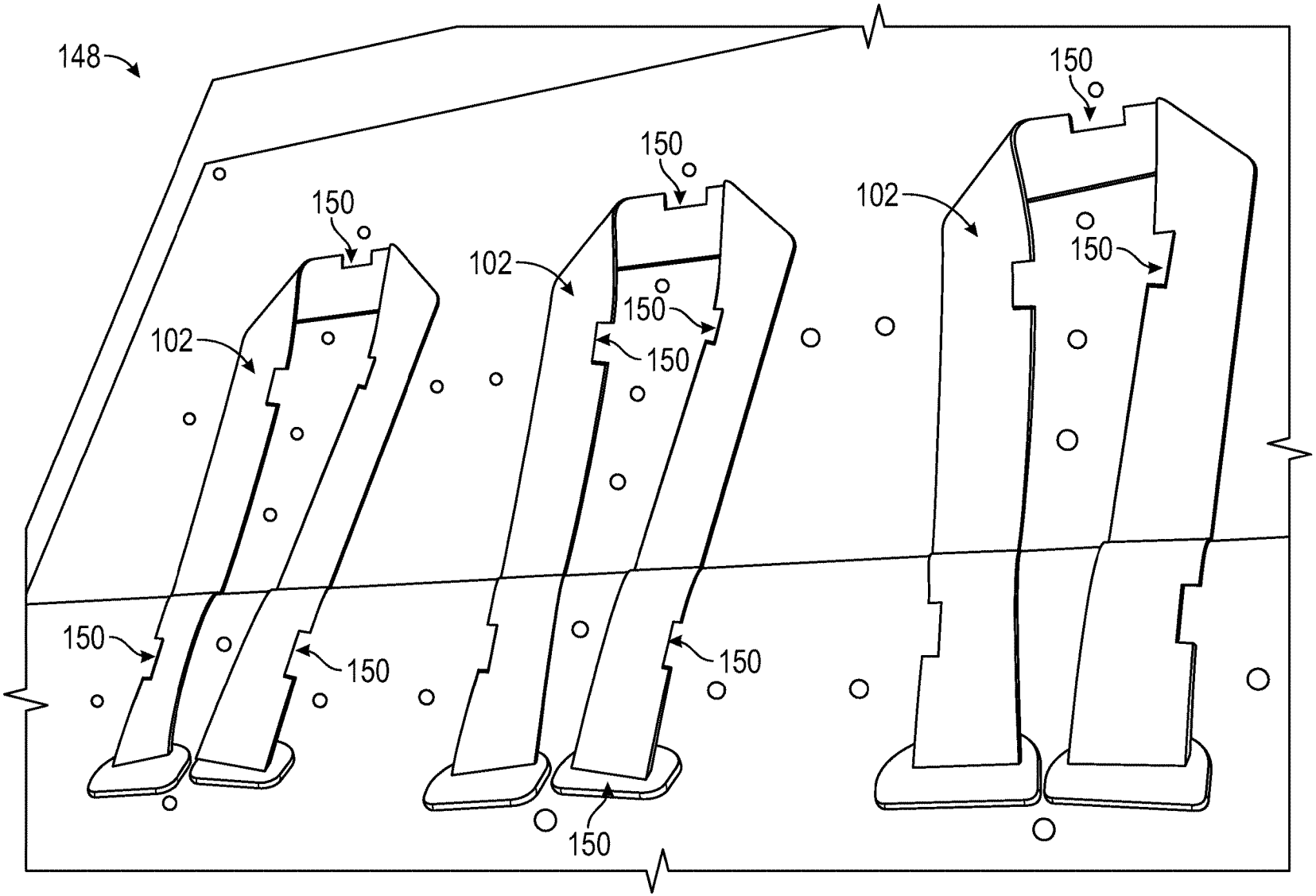
FIG. 5 is a schematic view of an exemplary frame structure for receiving a plurality of the lace-receiving structures.

As shown in FIG. 5, one or more forming structures 148 can be used to facilitate the additional treatment of the lace guides 102 prior to attachment to an upper. For example, FIG. 5 shows a frame structure that can receive a plurality of lace guides 102 in the folded configuration and hold them in that position by a plurality of securing members 150. In this orientation, the lace guides 102 can be subjected to a heat treatment, stitching treatment, and/or any other suitable attachment process to secure or maintain (permanently or temporarily) the facing surfaces of the folded portions in the desired configuration.

Figure 6:
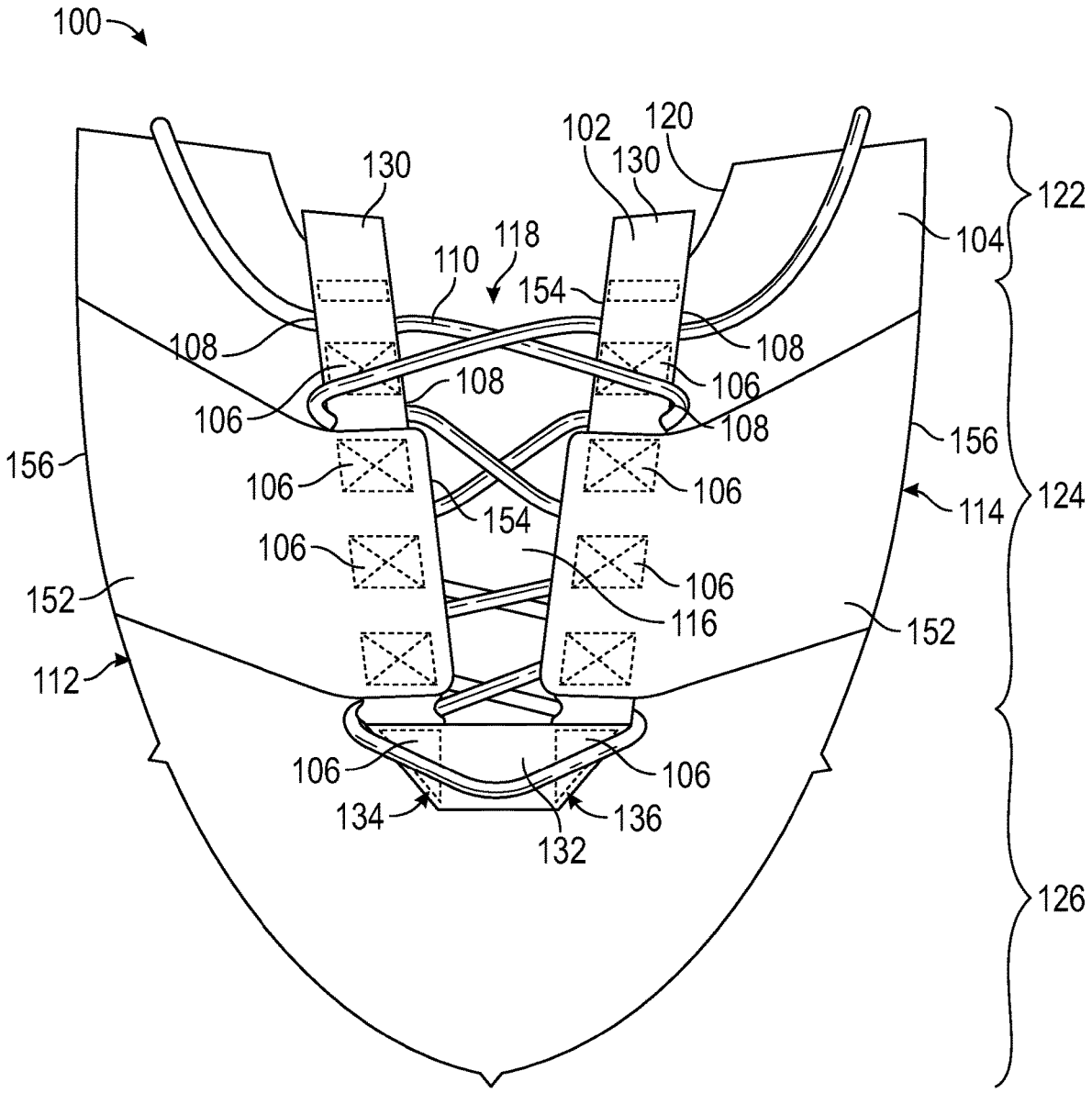
FIG. 6 is perspective view of another exemplary embodiment of a lace-receiving structure shown attached to a flat-formed upper.
Figure 7:
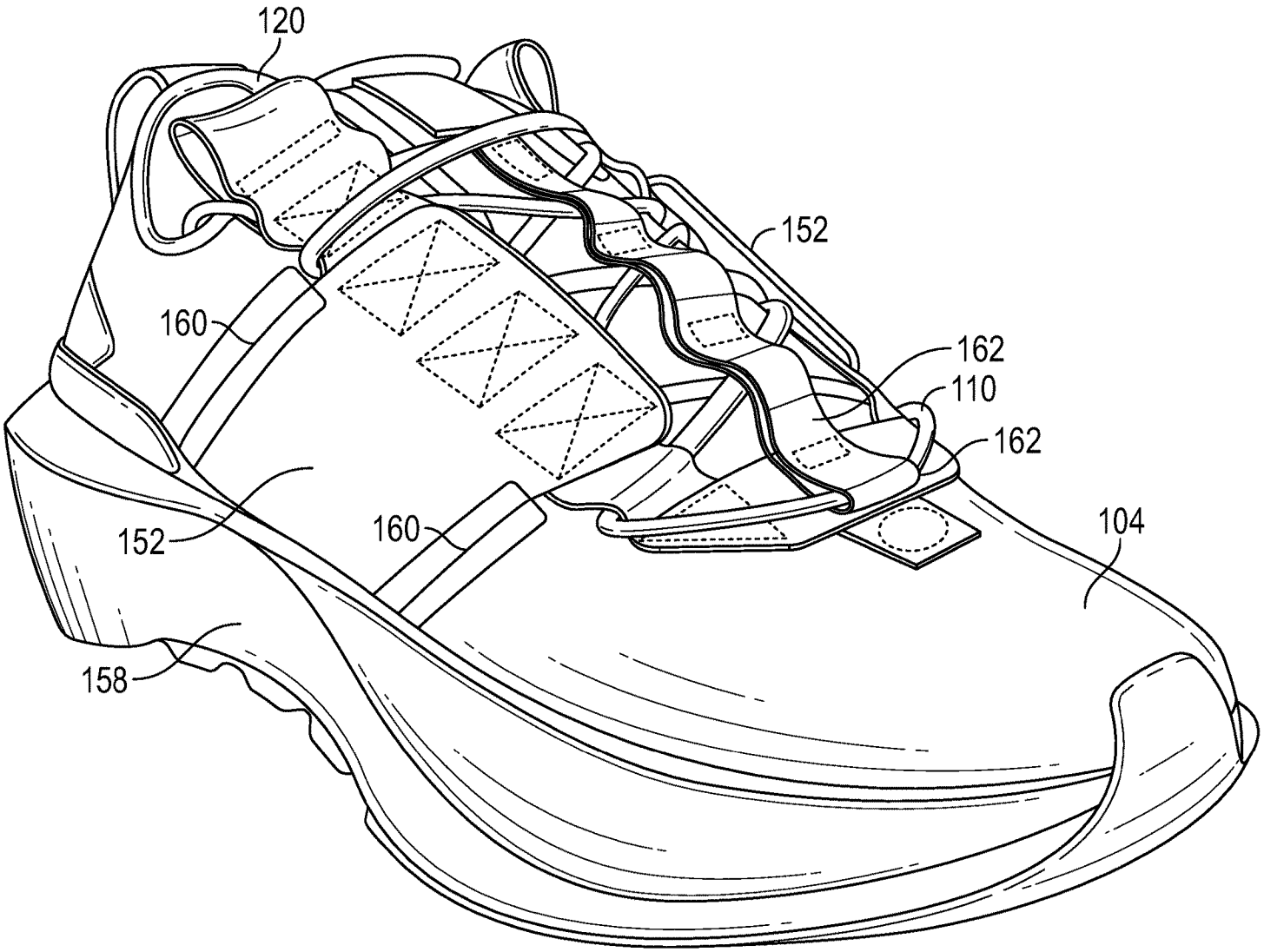
FIG. 7 a side view of another exemplary embodiment of a lace-receiving structure attached to an upper of an article of footwear.

FIGS. 6-8 illustrate another embodiment in which at least a portion of the lace guide 102 is covered by another structure (e.g., a portion of the upper and/or a material attached to an outer surface of the upper and/or sole structure.

Referring to FIG. 6, a pair of covering portions 152 are provided on each of the medial side 112 and lateral side 114. The covering portions 152 extend across at least a portion of the lace guide 102. In the embodiment shown in FIG. 6, the covering portions 152 extend across three attached regions 106 on each side and extend over a side of the apertures 108 defined by those attached regions 106 that is furthest from the throat area 118. However, it should be understood that the extent that the covering portions extend over the lace guide can vary.

The covering portions 152 can be secured to the lace guide 102 and/or the upper 104 by any known attachment means. For example, in FIG. 6, the covering portions are stitched to the lace guide 102 (and/or the upper 104 below the lace guides 102) in the same manner that the lace guide 102 is stitched to the upper. In some embodiments, the attachment means can be applied to the lace guide 102 through the covering portions 152. That is, the covering portions 152 can be stitched to the lace guide 102, thereby securing the lace guide 102 to the upper 104 in the same step. Alternatively, separate stitching operations (or other fastening steps) can be performed to attach the covering portion 152 to the lace guide 102 and to attach the lace guide 102 to the upper 104.

Of course, covering portions 152 can be secured to the upper using any other fastening means described herein, including for example, mechanical fasteners (e.g., rivets), stitching, and/or adhesives.

In the embodiment shown in FIG. 6, covering portions 152 have a first end 154 secured to the lace guide 102 and/or upper 104 and a second end 156 that extends to the lower portion of the upper 104. In some embodiments, the second end can be secured at the bite line (i.e., in the region of the upper where it is secured to the sole structure 158) as shown in FIG. 7. The covering portions 152 can also be secured to the upper 104 at areas of the upper 104 away from the sole structure 158 and throat area 118. For example, as shown in FIG. 7, covering portions 152 can be secured to the upper at a rearward and forward side, such as by stitching 160.

In addition, in some embodiments, the lace member 110 can be secured and/or received at a location forward of the throat area 118. For example, FIG. 7 illustrates a forward aperture 162 that receives a portion of the lace member 110. In some embodiments, the forward aperture can be formed from and/or secured to the intermediate portion 140 of the lace guide. In the embodiment shown in FIG. 7 a second lace guide 164 extends longitudinally along the throat area 118 and includes one or more apertures that can receive the lace member 110, including the forward aperture 162. Although the forward aperture of FIG. 7 is part of a structure that extends along the throat area 118, if desired a forward aperture 162 can be secured to the upper and/or the lace guide 102 (e.g., as shown in FIG. 1).

Figure 8A:
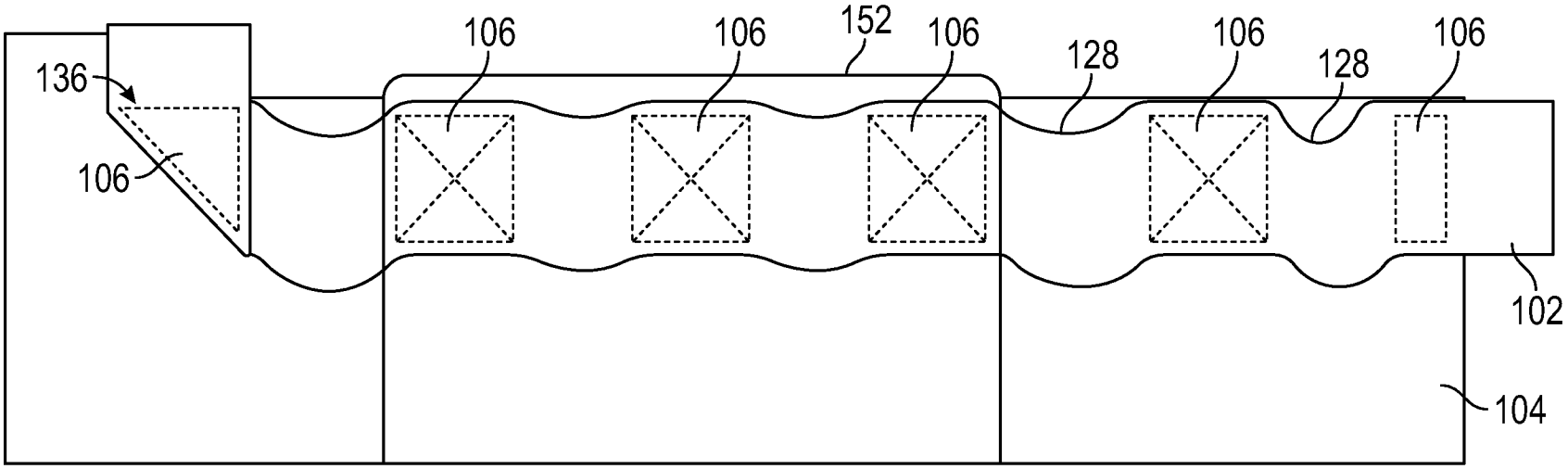
FIGS. 8A and 8B illustrate views of another exemplary lace-receiving structure attached to a surface of an upper.
Figure 8B:
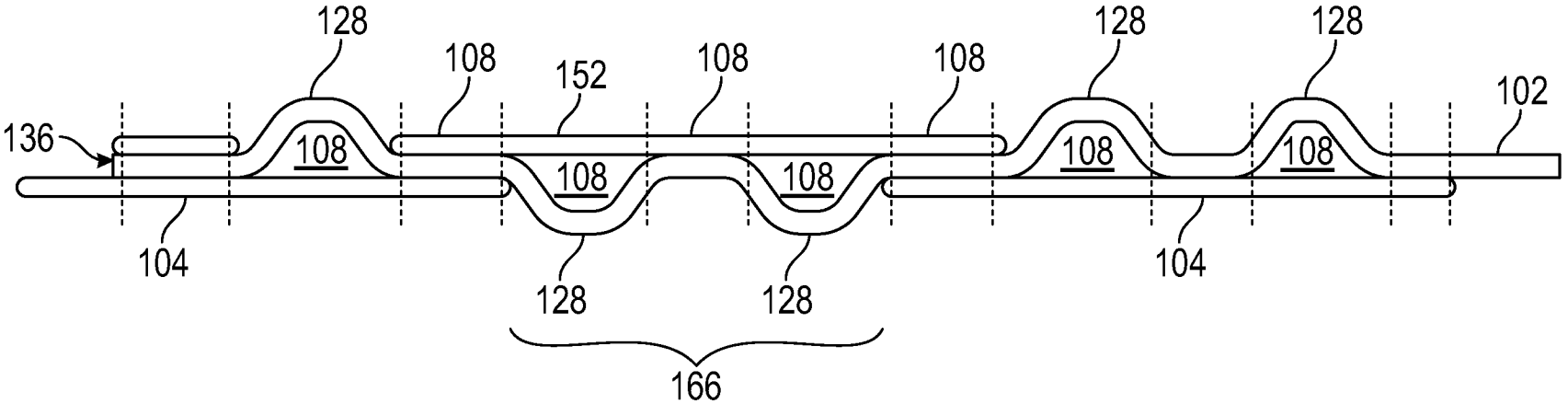

FIGS. 8A and 8B illustrate additional details of an exemplary lace guide 102 attached to an upper 104, with covering portions 152 at least partially covering the lace guide 102. As shown in FIGS. 8A and 8B, the attached regions 106, which can include the folded portions in some embodiments, and adjacent unattached regions 128 can define, in combination with the underlying surface of the upper 104, a plurality of apertures through which one or more lace members can be received.

As shown in FIG. 8B, in some embodiments, upper 104 can have one or more discontinuous sections 166 that can comprise a gap and/or opening in the upper. In such embodiments, the lace guide 102 can bridge the gap and/or opening of the discontinuous section 166 shown in FIG. 8B.

Figure 9:
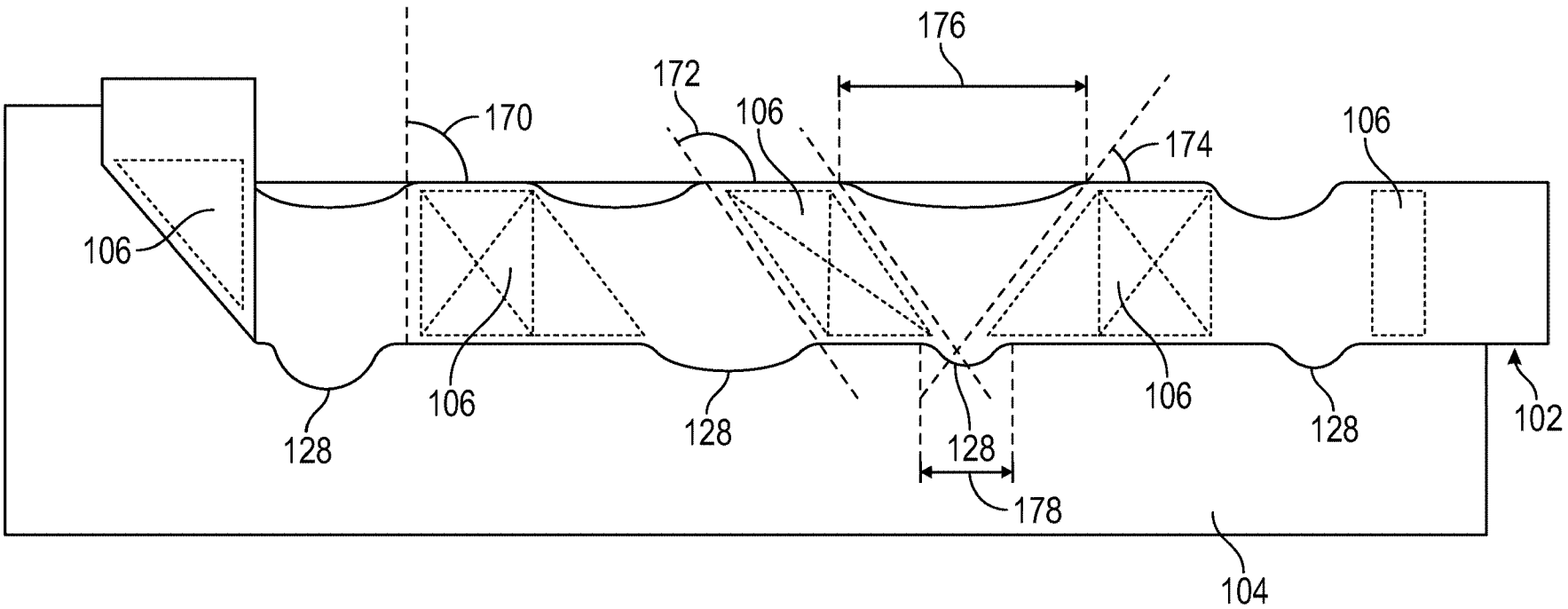
FIG. 9 illustrate a view of another exemplary lace-receiving structure attached to a surface of an upper.

Apertures 108, and the respective passageways of the apertures, can be formed to have any desired entrance/exit angle relative to the lace guide. For example, as shown in FIG. 9, apertures 108 can define an angle 170 of about 90° relative to a lengthwise edge of the lace guide 102. Alternatively, angles greater or less than 90° can be formed. In some embodiments, the apertures define the same angle along one side of the lace guide 102. In other embodiments, the apertures can define two or more different angles along one side of the lace guide 102, or two or more angles along both sides of the lace guide 102.

For example, referring to FIG. 9, a first aperture is shown with an angle 172 that is greater than 90° and a second aperture with an angle 174 that is less than 90°. In some embodiments, the angle can vary from 70° and 120°, or from 80° to 110°. In addition, as shown in FIG. 9, a first side width (e.g., a throat area side width) of an aperture can be different from the opposite side width of the aperture. For example, FIG. 9 illustrates a first side width 176 that is greater than an opposite side width 178. Although shown with the throat side width being greater than the opposite side, alternatively, the openings to the aperture can be reversed so that the throat side width is smaller than an opposite side width.

Additional Examples of the Disclosed Technology

Additional examples of the disclosed technology are enumerated in the clauses below.

Clause 1: An article of footwear comprising an upper that has a lateral side, a medial side, and a throat area between the medial and lateral sides; and a lace guide attached to the upper, the lace guide comprising a first portion that extends along the medial side of the upper, a second portion that extends along a lateral side of the upper, and an intermediate portion that extends between the first and second portions, wherein the first portion and second portion at least partly define a plurality of apertures that can receive a lace member, and the lace guide is a continuous piece of material that includes the first portion, the intermediate portion, and the second portion.

Clause 2. The article of footwear of clause 1, wherein the lace guide comprises a plurality of attached regions and a plurality of unattached regions, and the unattached regions define the plurality of apertures in combination with a surface of the upper.

Clause 3. The article of footwear of any of the preceding clauses, wherein the intermediate portion comprises a first folded region adjacent the first portion and a second folded region adjacent the second portion.

Clause 4. The article of footwear of clause 2, wherein the plurality of attached regions are secured to the upper by stitching.

Clause 5. The article of footwear of clause 2, wherein the plurality of attached regions are secured to the upper by mechanical fasteners, a heat treatment, and/or adhesives.

Clause 6. The article of footwear of clause 2, wherein the apertures define tunnels that extend from a first longitudinal side of the lace guide to a second longitudinal side of the lace guide, the first longitudinal side of the lace guide being closer to the throat area than the second longitudinal side.

Clause 7. The article of footwear of clause 6, wherein at least some of the tunnels are at an angle relative to an adjacent area of the first longitudinal side, the angle being between 80 and 110.

Clause 8. The article of footwear any of the preceding clauses, further comprising a first covering member and a second covering member, the first covering member extending over at least a portion of the first portion of the lace guide and the second covering member extending over at least a portion of the second portion of the lace guide.

Clause 9. The article of footwear of clause 8, wherein the first covering member extends from a sole structure to the first portion of the lace guide and the second covering member extends from the sole structure to the second portion of the lace guide, wherein the first covering member is attached to the first portion of the lace guide and the second covering member is attached to the second portion of the lace guide.

Clause 10. A lace guide for attachment to an upper of an article of footwear, comprising a first longitudinal portion, a second longitudinal portion spaced apart from the first longitudinal portion to define a gap therebetween; and an intermediate portion that includes a first folded region adjacent the first longitudinal portion and a second folded region adjacent the second longitudinal portion, wherein the lace guide is a continuous piece of material that includes the first portion, the intermediate portion, and the second portion.

Clause 11. The lace guide of clause 10, wherein the lace guide has a top surface, a first side, and a second side opposite the first side, wherein the first side defines the top surface in the first and second longitudinal portions and the second side defines the top surface in the intermediate portion.

Clause 12. The lace guide of any one of clauses 10-11, wherein the first and second folded regions comprises adjacent facing surfaces of the first side of the lace guide.

Clause 13. The lace guide of clause 12, wherein the facing surfaces of the first and second folded regions are attached to each other.

Clause 14. The lace guide of clause 13, wherein facing surfaces of the first and second folded regions are secured by stitching.

Clause 15. The lace guide of clause 13, wherein facing surfaces of the first and second folded regions are secured by mechanical fasteners, a heat treatment, and/or adhesives.

Clause 16. The lace guide of any one of clauses 10-15, wherein the first longitudinal portion defines a first angle relative to the intermediate portion, and the second longitudinal portion defines a second angle relative to the intermediate portion, wherein the first and second angles range from 90° to 110°.

Clause 17. A method of forming an article of footwear, comprising, attaching the lace guide of any one of clauses 10-16 to an upper.

Clause 18. The method of clause 17, further comprising attaching the lace guide to the upper at a plurality of attached regions, wherein at least some adjacent ones of the plurality the plurality of attached regions are spaced apart by unattached regions, the unattached regions defining respective apertures in combination with a surface of the upper.

Clause 19. A method of forming a lace guide comprising providing a continuous strip of material having a first side and a second side opposite the first side; and forming an intermediate portion between a first portion of the continuous strip and a second portion of the continuous strip by folding the continuous strip at a first folded region and a second folded region, wherein a top surface of the lace guide is defined by the first side in the first and second portions, and the top surface is defined by the second side in the intermediate portion.

Clause 20. The method of clause 19, wherein the first and second folded regions comprises adjacent facing surfaces of the first side of the lace guide and the method further comprises attaching the adjacent facing surfaces to each other.

Clause 21. The method of clause 20, wherein the facing surfaces of the first and second folded regions are attached to each other by stitching.

Clause 22. The method of clause 20, wherein the facing surfaces of the first and second folded regions are attached to each other by any one or combination of a mechanical fastener, a heat treatment, or adhesive.

In view of the many possible embodiments to which the principles of the disclosure may be applied, it should be recognized that the illustrated embodiments are only examples and should not be taken as limiting the scope of the disclosure.

The invention claimed is:

1. An article of footwear comprising:

an upper that has a lateral side, a medial side, and a throat area between the medial and lateral sides; and a lace guide attached to the upper, the lace guide comprising a first portion that extends along the medial side of the upper in a first direction, a second portion that extends along the lateral side of the upper in a second direction, and an intermediate portion that extends between the first and second portions to space the first and second portions apart on opposing sides of the throat area, wherein the first portion and the second portion at least partly define a plurality of apertures that can receive a lace member, and the lace guide is an elongate continuous piece of material that includes the first portion, the intermediate portion, and the second portion, wherein the intermediate portion comprises a first folded region adjacent the first portion a second folded region adjacent the second portion, wherein the elongate continuous piece of material has a first side and a second side that is opposite the first side, and the first side faces away from a surface of the upper at the first and second portions, and the first side faces toward the surface of the upper at the intermediate portion, and wherein the first folded region and the second folded region cause the intermediate portion to extend in a direction different from the first direction and the second direction, such that the intermediate portion extends from the medial side of the upper to the lateral side of the upper.

2. The article of footwear of claim 1, wherein the lace guide comprises a plurality of attached regions and a plurality of unattached regions, and the unattached regions define the plurality of apertures in combination with a surface of the upper.

3. The article of footwear of claim 2, wherein the plurality of attached regions are secured to the upper by stitching.

4. The article of footwear of claim 2, wherein the plurality of attached regions are secured to the upper by mechanical fasteners, a heat treatment, and/or adhesives.

5. The article of footwear of claim 2, wherein the apertures define tunnels that extend from a first longitudinal side of the lace guide to a second longitudinal side of the lace guide, the first longitudinal side of the lace guide being closer to the throat area than the second longitudinal side.

6. The article of footwear of claim 5, wherein at least some of the tunnels are at an angle relative to an adjacent area of the first longitudinal side, the angle being between 80 and 110.

7. The article of footwear of claim 1, further comprising a first covering member and a second covering member, the first covering member extending over at least a portion of the first portion of the lace guide and the second covering member extending over at least a portion of the second portion of the lace guide.

8. The article of footwear of claim 7, wherein the first covering member extends from a sole structure to the first portion of the lace guide and the second covering member extends from the sole structure to the second portion of the lace guide, wherein the first covering member is attached to the first portion of the lace guide and the second covering member is attached to the second portion of the lace guide.

9. A lace guide for attachment to a medial and a lateral side an upper of an article of footwear, comprising:

a first longitudinal portion extending in a first direction;

a second longitudinal portion extending in a second direction, the second longitudinal portion being spaced apart from the first longitudinal portion to define a gap therebetween; and an intermediate portion that includes a first folded region adjacent the first longitudinal portion and a second folded region adjacent the second longitudinal portion, the intermediate portion being sized to space the first longitudinal portion apart from the second longitudinal portion across a throat area of the article of footwear, wherein the lace guide is an elongate continuous piece of material that includes the first portion, the intermediate portion, and the second portion, wherein the lace guide has a first side and a second side opposite the first side, wherein the first side defines a top surface in the first and second longitudinal portions and the first and second folded regions cause the intermediate portion to have a different top surface than the first and second longitudinal portions so that the second side defines the top surface in the intermediate portion, and wherein the first folded region and the second folded region cause the intermediate portion to extend in a direction different from the first direction and the second direction, such that the intermediate portion extends across the gap.

10. The lace guide of claim 9, wherein the first and second folded regions comprises adjacent facing surfaces of the first side of the lace guide.

11. The lace guide of claim 10, wherein the facing surfaces of the first and second folded regions are attached to each other.

12. The lace guide of claim 11, wherein facing surfaces of the first and second folded regions are secured by stitching.

13. The lace guide of claim 11, wherein facing surfaces of the first and second folded regions are secured by mechanical fasteners, a heat treatment, and/or adhesives.

14. The lace guide of claim 9, wherein the first longitudinal portion defines a first angle relative to the intermediate portion, and the second longitudinal portion defines a second angle relative to the intermediate portion, wherein the first and second angles range from 90° to 110°.

15. A method of forming an article of footwear, comprising, attaching the lace guide of claim 9 to an upper.

16. The method of claim 15, further comprising attaching the lace guide to the upper at a plurality of attached regions, wherein at least some adjacent ones of the plurality the plurality of attached regions are spaced apart by unattached regions, the unattached regions defining respective apertures in combination with a surface of the upper.

* * * * *